US005560165A

United States Patent [19]

Hoefsloot et al.

[11] Patent Number: 5,560,165

[45] Date of Patent: Oct. 1, 1996

[54] JOINT BETWEEN A LANDING DOOR AND WALL STRUCTURES

[75] Inventors: Leon Hoefsloot, Chaudfontaine, Belgium; Ari Ketonen, Hyvinkää, Finland

[73] Assignee: KONE Oy, Helsinki, Finland

[21] Appl. No.: 219,300

[22] Filed: Mar. 28, 1994

[30] Foreign Application Priority Data

Mar. 30, 1993 [FI] Finland ..... 931444

[51] Int. Cl.[6] ..... E04B 1/76; E06B 1/04

[52] U.S. Cl. ..... 52/210; 52/204.1; 52/211

[58] Field of Search ..... 52/204.1, 207, 52/394, 396.01, 396.04, 210, 213, 215, 217, 211; 49/475.1, 500.1, 504

[56] References Cited

U.S. PATENT DOCUMENTS 3,735,539 5/1973 Pfund ..... 52/204.1
4,489,527 12/1984 Haas .
4,530,189 7/1985 Randall ..... 52/215
5,263,293 11/1993 Gohlke et al. ..... 52/396.01

FOREIGN PATENT DOCUMENTS 1434649 5/1976 United Kingdom ..... 52/396.01

*Primary Examiner*—Michael Safavi

[57] ABSTRACT

The invention relates to a system for joining the frame of a landing door (7) of an elevator to the wall structure (4) surrounding the frame, in such a way that the elevator shaft (5) is isolated from the rest of the space in the building. According to the invention, a heat-resistant protective element (9) flexible in normal temperature and at least in a temperature of 500° is fitted between the frame (8) and the wall structure (4), said element being attached to the door frame (8) and to the shaft wall structure (4).

3 Claims, 4 Drawing Sheets

JOINT BETWEEN A LANDING DOOR AND WALL STRUCTURES

The present invention relates to a system for joining the frame of a landing door of an elevator to the surrounding wall structure.

BACKGROUND OF INVENTION

When an elevator is to be installed in a building, the delivery limit for the elevator supplier on each floor is generally the door opening provided for a door in the landing wall. As the case may be, the door opening is somewhat larger than the space required by the frame of the landing door. The gap remaining between the frame and the wall structure has to be covered not only because of esthetic and safety considerations but also to comply with the fire safety regulations of many countries. The door and the structure joining it to the door opening must withstand for example heat of 1000° C. for two hours. On the other hand, the operating environment may require structures as light and inconspicuous as possible. For example, in an elevator shaft with glass walls, the aim is to maximize the transparent wall area.

In elevator technology, there were previously known solutions in which a vertical steel plate is attached to the vertical part of the frame of the landing door of the elevator, on the side facing the shaft. The plate is also attached to the wall structure. Alternatively, the other edge of the plate is not attached to the wall but the gap between the plate and the wall was sealed with insulating material. In another previously known solution, the gap between the frame and the wall was simply filled with insulating material in cases where tight mounting tolerances have been achieved.

The problem in previously known technology is that the manufacturing tolerances may vary considerably, which means that plates of several widths must be available. In case of fire, the structures undergo deformations causing changes in the gap between the frame and the door opening. Especially if materials deformable in fire situations are used, a gap providing passage for flames between the shaft and the landing will be formed, particularly when the insulating material is completely loosened. In scenic elevators, the supporting structures and therefore also the supports surrounding the door opening as well as the frame placed in the opening are made as light and small as possible. Solving the problems with previously known technics requires extra work and materials, increasing the costs.

SUMMARY OF THE INVENTION

The object of the present invention is to achieve a new solution for joining the landing door frame to the wall structure of the elevator shaft so as to meet the insulation requirements pertaining to use and safety, for example those relating to flameproofness, and is simple to manufacture and install.

Using the solution of the invention, a reliable isolation between the floor space and the shaft space in fire situations is achieved, meeting the requirements regarding flameproofness. The structure is simple to install even when the delivery dimensions of the elevator or shaft differ considerably from the designed values. Because of its light weight and small dimensions, the structure is inconspicuous and requires no separate covering or protecting structures in the shaft even if the shaft is transparent. The protective element is installed using normal tools and the installation does not require several stages of operation. The protective element can be mounted on the landing door frame at the factory, in which case the rolled-up element only has to be opened and fixed to the door opening in the wall.

DETAILED DESCRIPTION OF THE INVENTION

Figure 1:
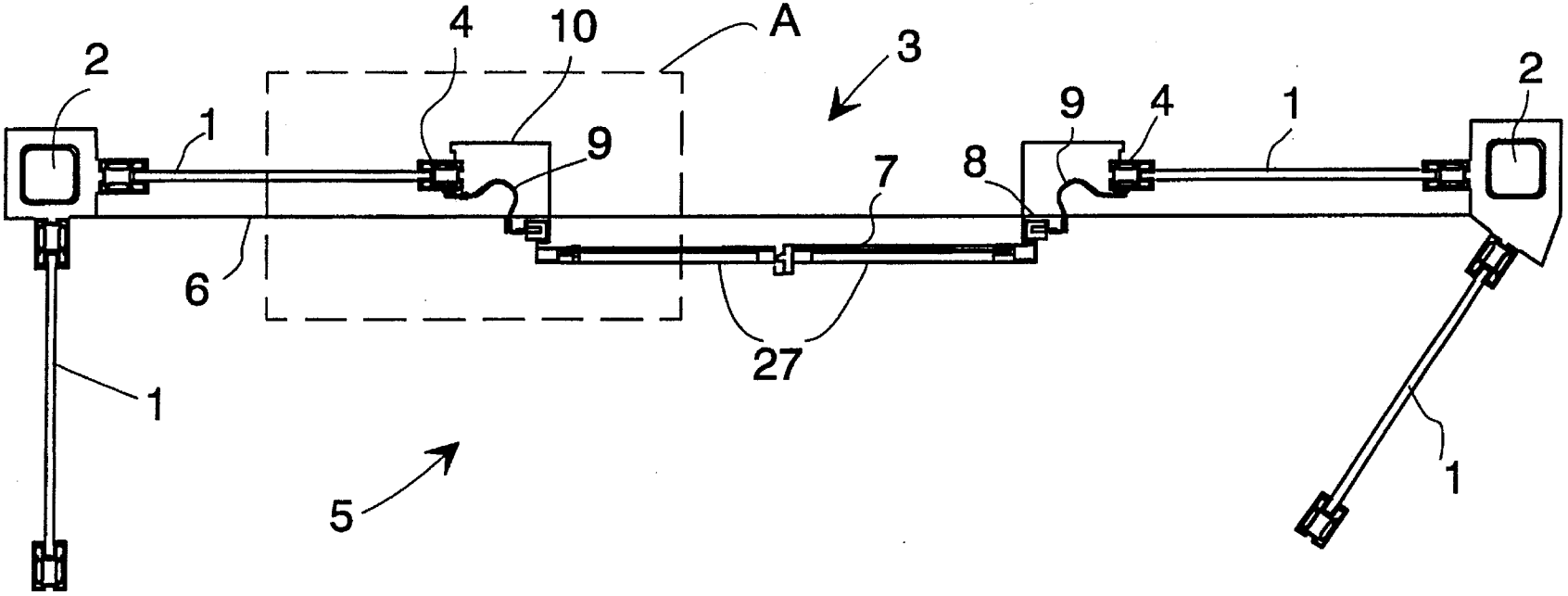
FIG. 1 illustrates a cross-section of a shaft wall with a door as seen viewed from above

FIG. 1 illustrates the structure of a shaft wall with a door at the level of a landing. The shaft is composed of glass sheets 1 attached to supporting structures 2 at the corners of the shaft and to supporting structures 4 surrounding the door opening 3 and forming part of the shaft wall structure. At the level of the landing, the shaft is limited by the edge 6 of the landing floor. Mounted in the door opening 3 is a landing door 7 consisting of door panels 27 and the frame 8 of the landing door. In this embodiment, the landing door 7 is made of laminated sheet glass which meets the requirements imposed on a fire door.

The frame 8 and the supporting structure 4 surrounding the door opening are joined with a protective element 9 which extends over the entire common length of the frame 8 and the supporting structure and covers the gap between them. The protective element 9 is attached by its side edges to the frame 8 and to the supporting structure 4 as shown in greater detail in FIG. 3. In a corresponding manner, the upper edge of the frame 8 is attached to the wall structure above it by means of a protective element. In addition, the frame 8 and the supporting structure 4 are joined on the landing side with a jamb structure 10 covering the protective element 9 and its fixing means.

Figure 2:
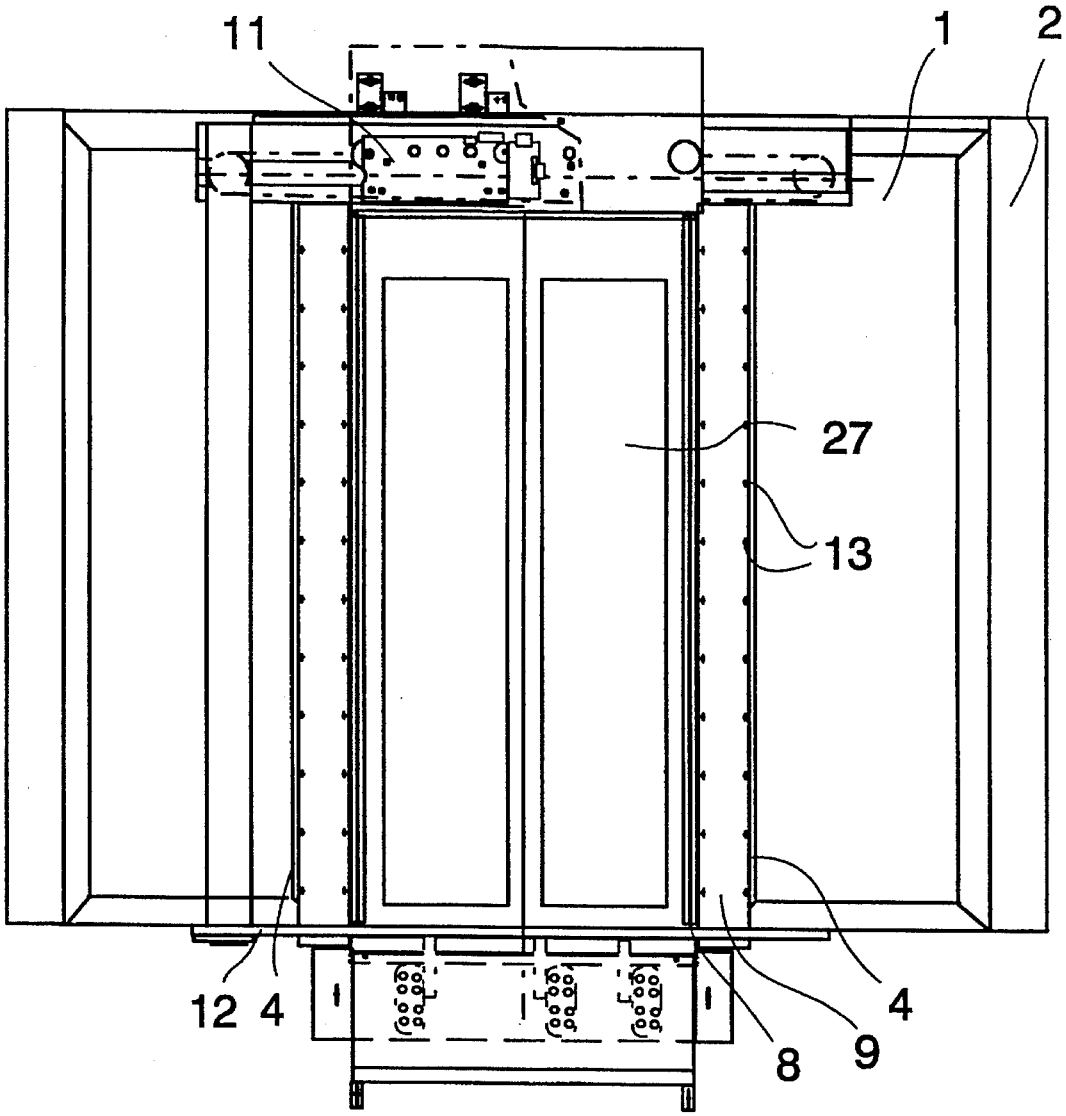
FIG. 2 illustrates a shaft wall with a door as seen from a side facing the shaft.

FIG. 2, which uses reference numbers corresponding to those used for the same parts in FIG. 1, illustrates a shaft wall with a door as seen from the side facing the shaft. The door panels of the door 7 are moved by means of an operating mechanism 11 comprising a motor and actuating devices as is the usual practice. The threshold 12 is provided with grooves supporting the lower ends of the door panels, which move along the grooves. The lower ends of the protective elements 9 between the frames 8 and the supporting structures 4 of the wall preferably extend below the level of the landing floor, so the landing and the shaft space are separated by the protective element 9. The protective elements 9 are attached to the frame 8 and to the supporting structure 4 by means of fixing elements 13 for example, rivets, screws or bolts.

Figure 3:
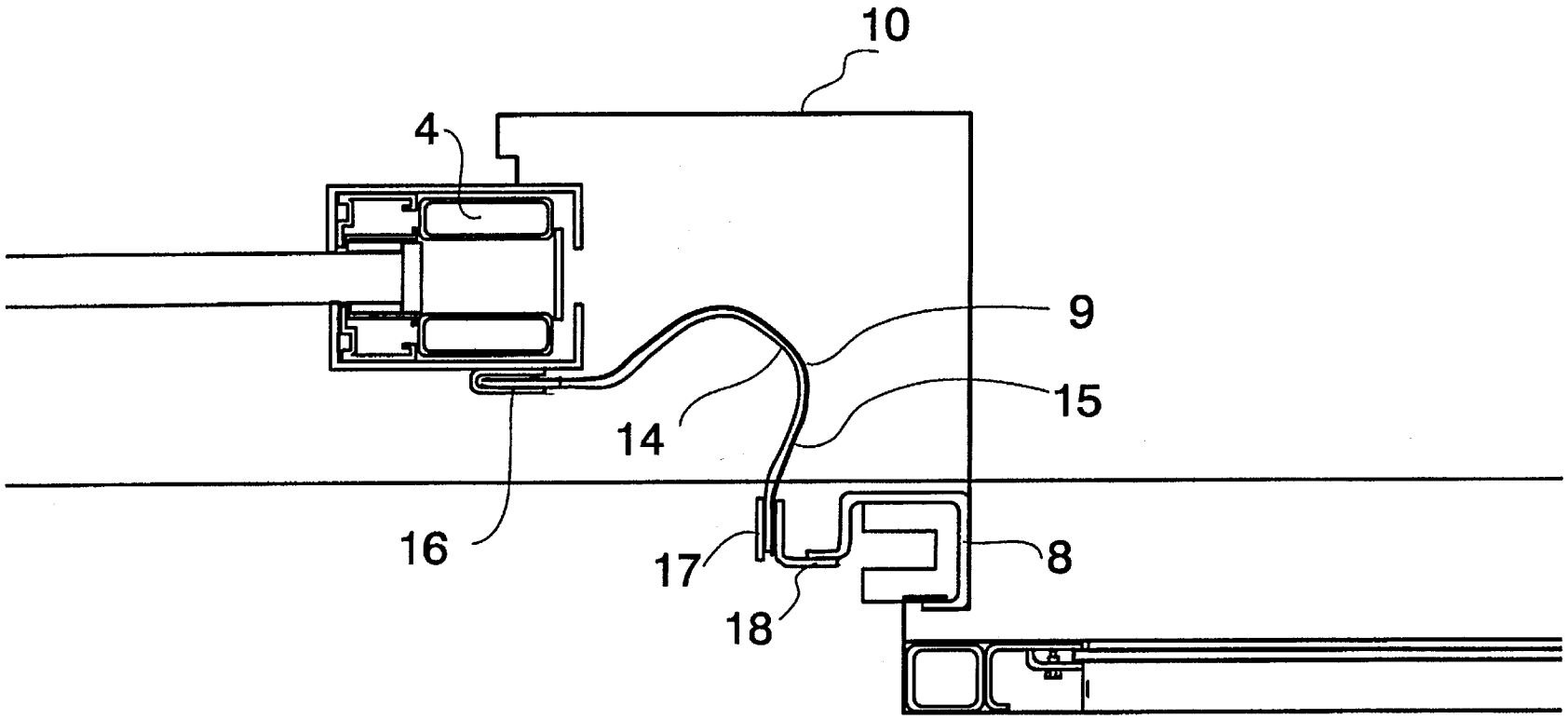
FIG. 3 illustrates a detail of FIG. 1.

FIG. 3 illustrates a magnified view of section A of FIG. 1, giving a more detailed illustration of the solution of the invention. The protective element 9 consists of a fireproof laminated structure which is flexible both at normal temperature, e.g. room temperature, and in a fire situation. The material of the element meets the flameproof requirement of the safety regulations. The protective element is so designed that it has a width sufficient to cover the gap between the door frame 8 and the supporting structure 4 of the wall. As the element is flexible and plastic, that part of the element which exceeds the width of the gap can be bent into the space remaining inside the jamb structure as shown in the figure. If necessary, the superfluous part of the protective elements can even be rolled up if there is very large variation in the design tolerances. On the side facing the shaft, the protective element 9 has a 3 mm thick layer 14 of ceramic paper capable of withstanding a continuous heat of 1200° C. without breaking. On the side facing the landing, the protective element 9 has a layer 15 of fireproof rubberlike material such as Nullifire$^R$, sprayed onto the ceramic paper to a thickness of about 1.5 mm.

Attached with a crimped joint to the lengthwise edges of the protective element 9 are reinforcing or fixing parts 16 and 17 made for example, of sheet steel. One of the fixing parts 16 is riveted or bolted onto the supporting structure 4, while the other fixing part 17 is riveted or bolted onto the door frame 8 by a flange 18 comprised in the fixing part. As the protective element 9 is made of a fireproof material that does not conduct heat, it provides a reliable isolation between the shaft and the landing and prevents the conduction of heat from the wall structure to the door unit. Due to its flexibility, the insulation is preserved even when the structures are deformed by heat or undergo other changes of form.

If desired, the protective element 9 can be provided with a coat of fireproof material on the other side as well. To facilitate installation on site, it is preferable to fasten the protective element to the door frame at the factory and roll it up for transportation. In this case, the fixing parts attached to the frame can be implemented as parts of the frame.

Figure 4:
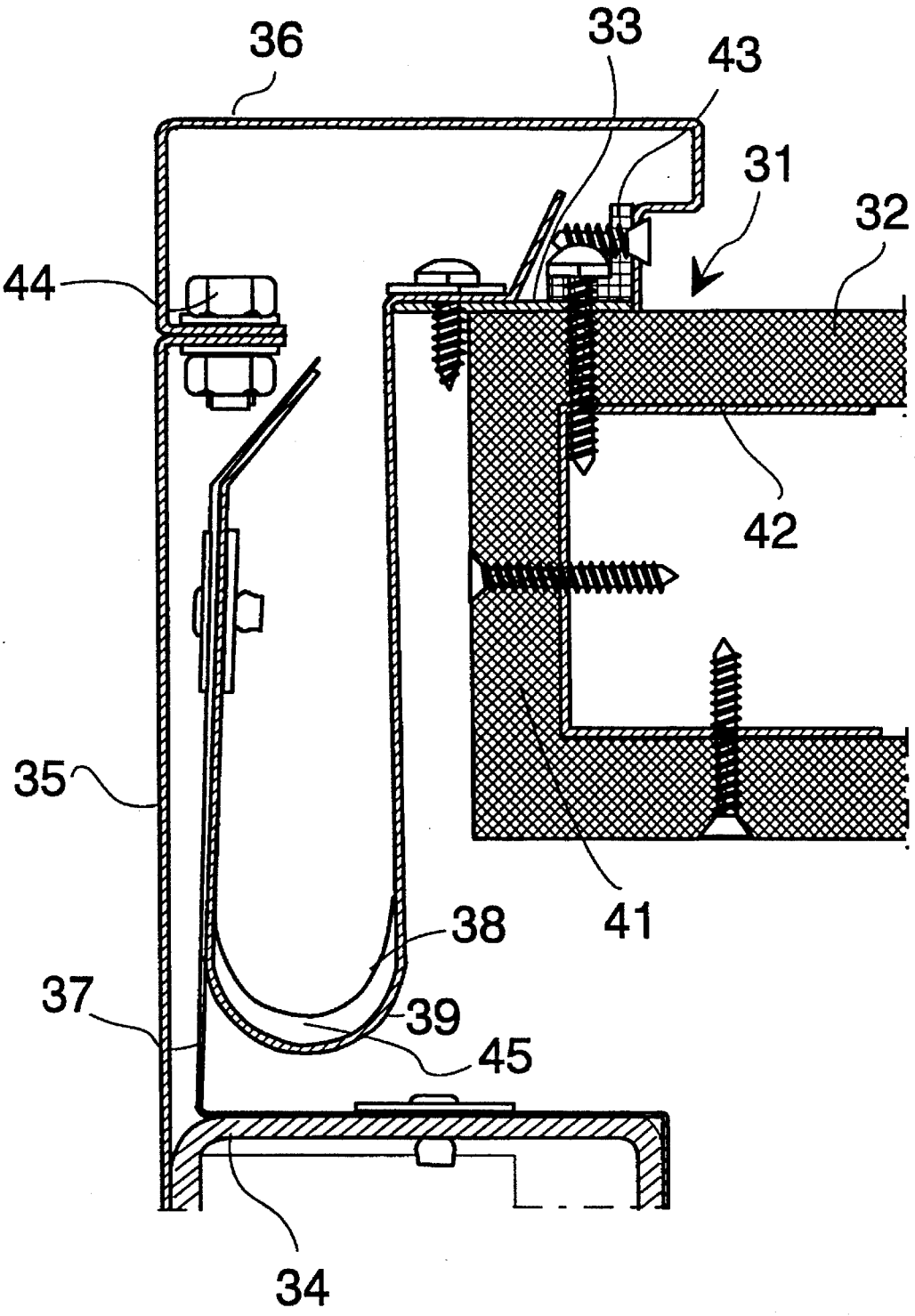
FIG. 4 presents a detail according to another embodiment.

FIG. 4 illustrates another solution according to the invention for joining the wall and the door frame to each other. In this case, the wall structure 31 is implemented as a hollow structure with wall plates 32 on both sides of it. The edge part 41 of the wall is made of the same kind of plate. The edge part of the wall is secured by means of a bracing structure 42, which is fixed with screws to the wall plates 32 and to the ! edge part 41. Attached to the wall plate facing the landing is also a steel plate 33, which is provided with brackets 43 for part 36 of the jamb structure. The other part 35 of the jamb structure is attached to the door frame 34. Parts 35 and 36 are joined together with a screw joint 44. Fitted on the inside of the jamb structure, i.e. on the side facing the shaft, is a flexible and elastic protective element which in this embodiment consists of a fine-mesh steel wire net 38 and, placed alongside of it, a fireproof fabric 39, which may be for example Silane AA, Kerlan. The steel wire net 38 and the fabric 39 are attached by one edge to the steel plate 33 fixed to the wall. At the other edge, the net 38 and the fabric 39 are attached to another steel plate 37, which again is fixed to the door frame 34. The steel wire net 38 and the fabric 39 are not attached to each other and may have a gap 45 between them in the middle portion of the protective element. In this case, too, the protective element isolates the shaft space and the landing from each other in a fire situation when the walls and the door frame undergo deformations. The jamb structure is attached to the wall and door frame for example by means of plastic screws or equivalent fixing elements having a low resistance to strain. Thus the light fixing of the jamb structure allows the wall and the door frame deform during a fire situation while the protective element is fixed both to the wall and to the door frame. The protective element makes a flexible isolation between the shaft space and the landing. The forces due to the deformation of the door frame is not conducted to the wall and vice versa.

The protective element can be used also to isolate two rooms from each other or a room from the outside of the building. In this case the protective element is attached to two adjacent wall structures in the same way as the protective element is attached to wall structure around the door frame as described above. The wall may be made concrete, of glass or of other material.

The invention has been described above by the aid of one of its embodiments. However, the presentation is not to be regarded as limiting the sphere of protection of the invention, but instead the embodiments of the invention may vary within the limits defined by the following claims. For instance, the materials selected, the manner of fixing and installation and the dimensioning may have a wide range of variation.

We claim:

1. An elevator apparatus comprising:

a wall structure, an elevator door frame, a protective element being heat resistant and flexible at a normal temperature and at a temperature prevailing in a fire situation, means for connecting the protective element to the wall and elevator door frame, and a jamb connected to the wall and elevator door frame, with said protective element being located in said jamb, wherein the protective element is formed of a steel wire net layer and a fireproof fabric separated from each other only by an air gap.

2. The elevator apparatus according to claim 1, wherein the wall is hollow.

3. The elevator apparatus according to claim 1, wherein the jamb structure is connected to the wall and door frame by fixing elements having a low resistance to strain.

* * * * *